US005352867A

United States Patent [19]

Shota

[11] Patent Number: 5,352,867

[45] Date of Patent: Oct. 4, 1994

[54] HEAT COOKING APPARATUS WITH SMELL SENSOR

[75] Inventor: Minoru Shota, Higashiosaka, Japan

[73] Assignee: Sharp Kabushiki Kaisha, Osaka, Japan

[21] Appl. No.: 897,105

[22] Filed: Jun. 11, 1992

[30] Foreign Application Priority Data

Jun. 11, 1991 [JP] Japan ..... 3-138867
Jul. 15, 1991 [JP] Japan ..... 3-172926

[51] Int. Cl.[5] ..... H05B 1/02

[52] U.S. Cl. ..... 219/497; 219/506; 219/501; 219/707; 219/710

[58] Field of Search ..... 219/10.55 B, 506, 497, 219/494, 501, 508, 10.55 M

[56] References Cited

FOREIGN PATENT DOCUMENTS 0035622 1/1991 Japan .
3282698 12/1991 Japan .
0455275 2/1992 Japan .

OTHER PUBLICATIONS

Japanese Patent Laid-Open Application No. 3-107750, May 8, 1991; pp. 377-380.

*Primary Examiner*—Mark H. Paschall

[57] ABSTRACT

When heat cooking of food placed in a heating chamber of a microwave oven is started, smell given out of the food is detected and a cooking sequence program suitable for the kind of the food is automatically selected based on the information of the detected smell. Heat cooking of the food is carried out thereafter following the selected cooking sequence program. In parallel with this heat cooking, the smell given out of the food is detected to detect fire of the food based on the information of the detected smell. When fire of the food is detected, heating of the food is immediately interrupted, thereby preventing damage to the oven which is caused by abnormally high temperature in the heating chamber, while preventing further browning of the food.

10 Claims, 5 Drawing Sheets

HEAT COOKING APPARATUS WITH SMELL SENSOR

BACKGROUND OF THE INVENTION

1. Field of the Invention

The present invention relates to heat cooking apparatuses for example microwave oven, range oven and toaster oven, and more particularly, to a heat cooking apparatus which detects the smell emitted from food to determine the kind of food and the state of the cooked dish.

2. Description of the Background Art

In recent years, heat cooking apparatuses such as microwave oven have multiple functions including defrosting by microwave-heating, heat cooking, oven cooking and grill cooking by a heater etc. In addition, a users' need for simplifying household chores has created a big demand for automatic oven capable of cooking food conveniently, easily and quickly. Therefore, microwave ovens have been put to practical use in which heating time and adjustment of fire (microwave output or heat output) are automatically controlled by using a sensor for food of any kind and any quantity.

FIG. 5 is a sectional view showing a schematic structure of a conventional microwave oven.

With reference to FIG. 5, the microwave oven 60 includes a main body 1 of the cooking apparatus, the main body 1 having a heating chamber 2 provided therein for cooking food 13 by heating. Provided in the bottom portion of the heating chamber 2 is a turn table 3 on which the food 13 is put and which is rotated at the start of cooking of the oven 60, and provided in the upper portion of the heating chamber 2 is a magnetron 4 for supplying microwaves into the heating chamber 2. Provided at the rear portion of the heating chamber 2 are a heater 5 and a fan 6 for heating convection.

Further provided in the oven 60 is a sensor for use to control cooking of the food 13 as described as follows. That is, provided are a state of cooked food sensor 8 for sensing the state of cooked food 13, a weight sensor 9 provided in connection with the turn table 3 for sensing weight of the food 13 on the table 3, a temperature sensor 10 for sensing a temperature in the heating chamber 2 at the time of oven cooking or grill cooking, and a temperature sensor 11 for sensing the ambient temperature of the oven 60. The oven 60 is further provided with an air outlet 15 and a passage 16 for permitting atmospheric flow 14 evaporated from the food 13 in the heating chamber 2 to be discharged outside the chamber 2. The air outlet 15 is disposed in the rear portion of the main body 1, while the passage 16 is disposed to lead the atmospheric flow 14 in the chamber 2 to the air outlet 15.

The above-described sensor 8 is provided in the passage 16 to sense the atmospheric flow 14 passing through the passage 16, based on which sensing a state of the cooked food 13 is determined and based on which sensing output the degree of heating for cooking the food 13 is successively adjusted. Sensing methods of the sensor 8 include (1) a method of sensing, by using a thermistor, a rise of the atmospheric temperature caused by heating of food, (2) a method of sensing, by using a moisture sensor, a change in the amount of vapor generated by the heating of food and (3) a method of sensing, by using an infrared sensor, a change in the temperature of the food surface caused by the heating of the food.

Practically used as the weight sensor 9 include a sensor using a strain gauge and an electrostatic piezoelectric sensor.

Much importance is placed also on safety of heat cooking apparatuses. For example, when the food 13 is overheated to take fire (generation of smoke) due to defect of the microwave oven 60, heating portions such as the magnetron 4 and the heater 5 should be immediately stopped for safety. As a safety device in such a case, a thermofuse or the like is commonly used which cuts off power supply to the above-mentioned heating portions according to the output of the sensor 10 when the temperature in the heating chamber 2 exceeds a predetermined temperature.

When a user uses the above-described microwave oven 60 to cook food 13, first he distinguishes the kind of the food 13 and operates an external switch (not shown) provided on the front surface of the microwave oven 60 to designate the kind of food 13. Then, a microcomputer (not shown) contained in the oven 60 selects a heating sequence suitable for the food 13 based on the switch input signal and drives and controls the magnetron 4 and the heater 5 following the selected heating sequence. As described in the foregoing, while the conventional microwave oven 60 is capable of sensing the state of the cooked food 13 and weight thereof by using the sensors 8 and 9, it is not capable of distinguish a kind of the food 13. Therefore it is not possible for the oven 60 to automatically select a heating sequence appropriate to the food 13. For cooking the food 13 by the microwave oven 60, therefore, a user should manually operate keys in advance for designating a kind of the food 13. Thoroughly automatic cooking can not be done by the oven 60.

In addition, the thermo fuse used as the abovedescribed safety device takes much time to melt by heat. Thus, when the fuse melts to cut off a power supply path to the above-described heating portion, the temperature in the heating chamber 2 is already increased to a high temperature. As a result, scorched part of the food 13 is so large that it cannot be eaten. In addition, the microwave oven 60 itself is seriously damaged by high temperature. Such makes the user of the oven 60 feel anxious about using the oven and involves maintenance cost for recovering the damage, disadvantage in terms of cost.

SUMMARY OF THE INVENTION

Therefore, an object of the present invention is to provide a heat cooking apparatus capable of automatically distinguishing the kind of food to be cooked for automatic cooking appropriate to the food without requiring a user's manual operation of designating the kind of the food.

Another object of the present invention is to provide a heat cooking apparatus damage caused by overheating during cooking can be minimized.

In order to achieve the above-described objects, the heat cooking apparatus according to the present invention starts heating food, when a user puts the food in a heating chamber and instructs a start of heat cooking. When the food is heated, it gives out peculiar smell which is detected by a smell sensor. The kind of the food is distinguished based on the information of the detected smell. Then, a cooking sequence appropriate to the food is selected based on the distinction result and the food is heated following the selected cooking sequence. In addition, the smell of the food is detected by the smell sensor during this heat cooking. When it is detected based on the information of the detected smell that the food takes fire, the heating is immediately stopped.

As described in the foregoing, the heat cooking apparatus is provided with the smell sensor. The kind of food to be cooked is distinguished by using the sensor in response to an user's instruction of a start of heat cooking. A cooking sequence appropriate to the food is selected based on the distinction result and heating is carried out following the sequence. The user only needs to instruct a start of heat cooking and heat cooking following the cooking sequence appropriate to the food will be automatically carried out thereafter. This simplifies an operation to be made by the user for heat cooking, making it possible to drastically reduce the number of keys for operation. In addition, when food is overheated resulting in fire during heat cooking, heating is automatically stopped at once, so that damage of the heat cooking apparatus caused by the fire of the food can be minimized to enhance safety.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
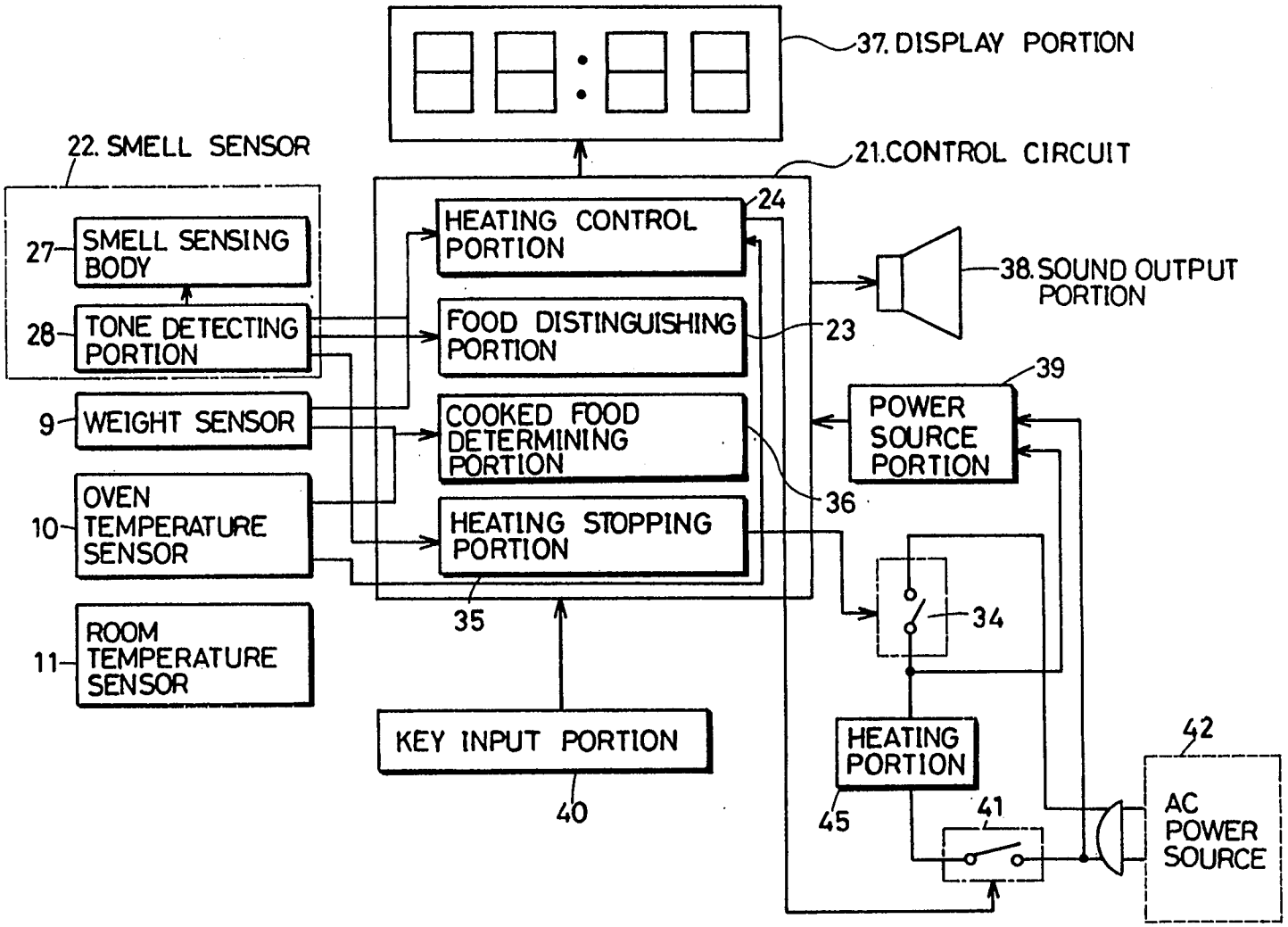
FIG. 1 is a diagram showing one example of a function block of a control device of a microwave oven according to one embodiment of the present invention.
Figure 2:
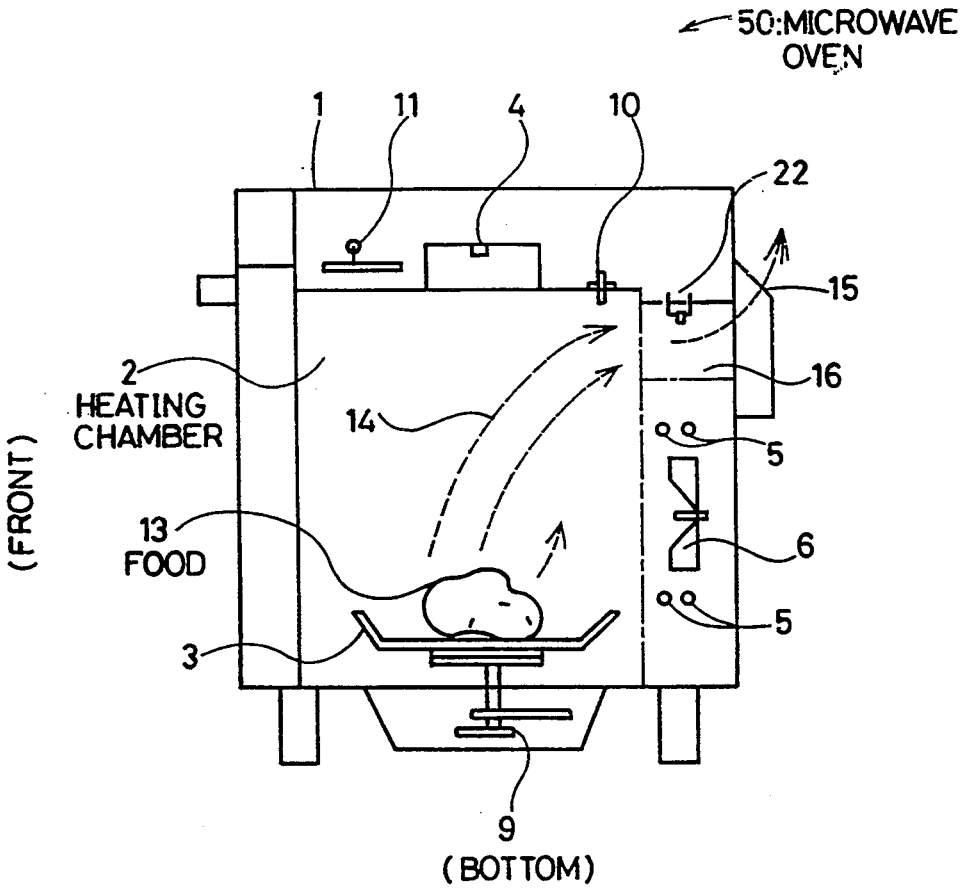
FIG. 2 is a sectional view showing a schematic structure of the microwave oven according to one embodiment of the present invention.

One embodiment of the present invention will be described in detail with reference to figures. FIG. 1 is a diagram showing a function block of a control device for use in a microwave oven according to one embodiment of the present invention. FIG. 2 is a sectional view showing a schematic structure of the microwave oven according to one embodiment of the present invention.

Figure 3A:
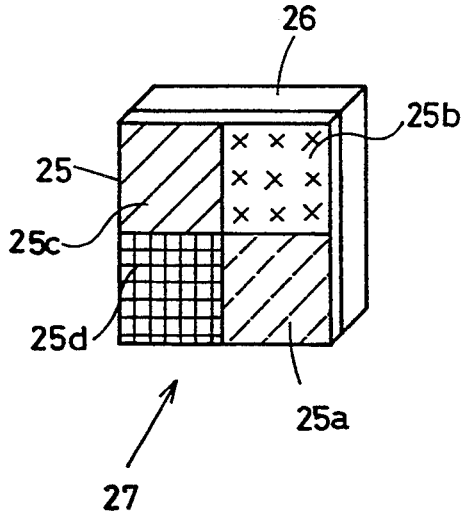
FIGS. 3A and 3B are diagrams showing the structure of a smell sensor for use in the microwave oven according to one embodiment of the present invention.
Figure 3B:
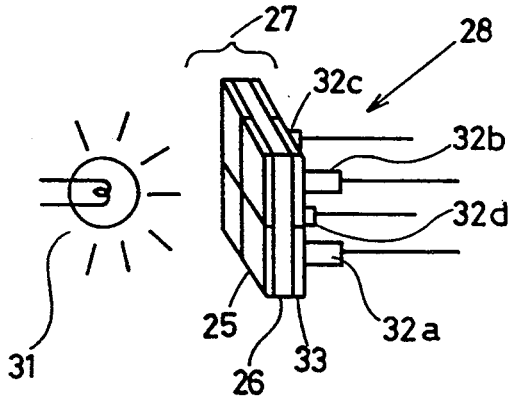

FIGS. 3A and 3B are diagrams showing the structure of a smell sensor for use in the microwave oven according to one embodiment of the present invention, FIG. 3A being a perspective view of a sensing body constituting the smell sensor and FIG. 3B being a perspective view of the smell sensor.

Figure 5:
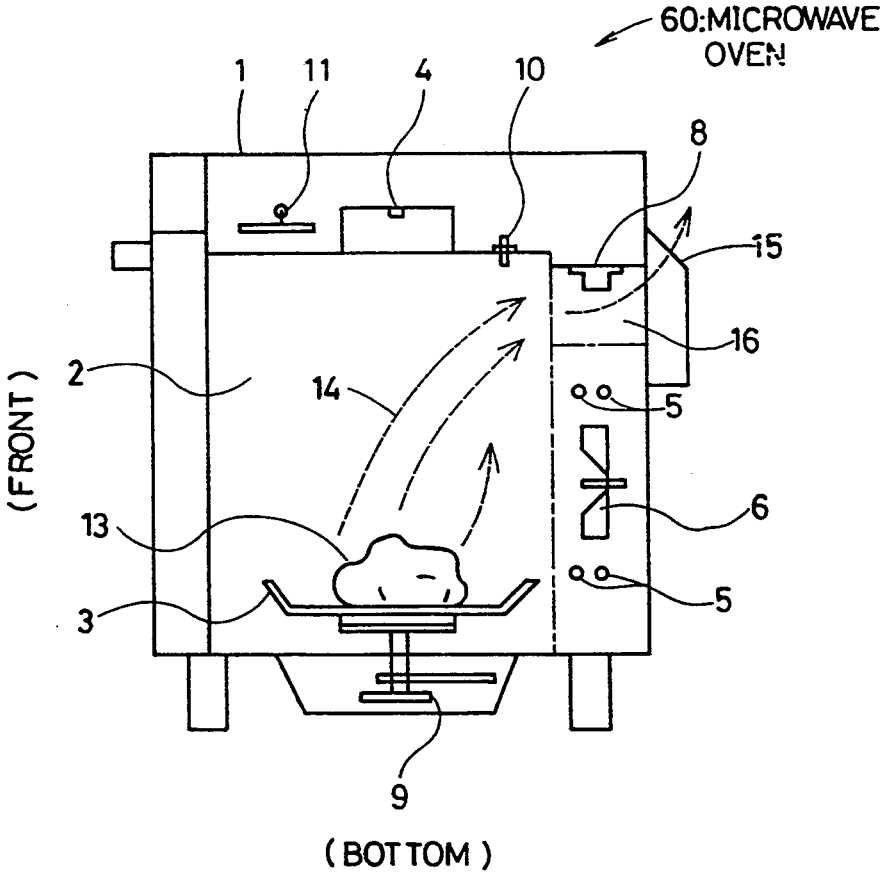
FIG.5 PRIOR ART
FIG. 5 is a sectional view showing a schematic structure of a conventional microwave oven.

In FIG. 2, the same reference numerals are given to the same or corresponding components of a microwave oven 50 of the present embodiment to those of the conventional microwave oven 60 shown in FIG. 5. Since the description of such components are made with reference to FIG. 5, they are not repeated here. Out of the respective components of the microwave oven 50, only a smell sensor 22 will be described, which has a different structure from that of the microwave oven 60.

With reference to FIG. 2, the smell sensor 22, replacing the state of cooked food sensor 8 shown in FIG. 5, is located at the same position as that of the sensor 8 to operate to sense smell contained in the atmospheric flow 14 when the flow 14 from the heat chamber 2 passes through the passage 16. The smell sensor 22 includes a smell sensing body 27 whose color is changed according to absorption/removal of a smell component and a tone detecting portion 28 for detecting the color of the smell sensing body 27. FIG. 3A is a perspective view showing the smell sensing body 27 and FIG. 3B is a perspective view showing the smell sensor 22.

With reference to FIG. 3A, the smell sensing body 27 includes a pigment film 25 whose color is changed according to a smell component included in the atmospheric flow 14 and which is formed on one of the main surfaces of a transparent substrate 26 made of glass or the like. The pigment film 25 is formed by "sorbite chromic pigment" and a "coloring pigment" which are functional pigment whose colors are changed according to absorption/removal of smell molecules. "Sorbite chromic pigments", such as betaine pigment, merocyanine pigment have their colors (visible light absorption spectrum) changed according to the internal energy which is changed by absorption/removaL of smell molecules, while "coloring pigments" such as triphenylmethane phthalyde pigment, indolyl phthalyde pigment have their colors (absorbance) changed as a result of a change of the molecule structures according to absorption/removal of smell molecules. These pigment materials dissolved in polymer solution are applied and dried on the main surface of the substrate 26, resulting in the film 25 including a betaine pigment film **25*a*, a merocyanine pigment film 25*b*, a triphenylmethane phthalyde pigment film 25*c* and an indolyl phthalyde pigment film 25*d* as shown in FIG. 3A**.

With reference to FIG. 3B, the tone detecting portion 28 comprises a light emitting element 31 including LED (light emitting diode), for example, light receiving elements **32*a*–32*d* including photoresistors, for example, and a color filter 33. The light emitting element 31 is provided at a position enabling uniform irradiation of the main surface of the pigment film 25. The color filter 33 is disposed on the main surface, of the opposite side to the film 25, of the substrate 26 to pass only a light having a specific wavelength out of the lights which are emitted from the light emitting element 31 and have passed through the film 25 and the substrate 26. The light receiving elements 32*a*–32*d* are provided in proximity to the filter 33 so as to receive the light which has passed through the same. As shown in the figure, the light receiving elements 32*a*–32*d* are provided individually for the respective pigment films 25*a*–25*d* and therefore, a light receiving level of each light receiving element is equivalent to a transmittance of the light having a specific wavelength for each pigment film, that is, a transmittance of a specific color light. Then, by representing the light transmittance of each of the light receiving elements 32*a*–32*d* as a pattern, a kind of smell molecules absorbed in the pigment film 25 can be distinguished according to the pattern. Further details of the smell sensor 22 using the pigment film 25 and the pigment film 25** itself are disclosed in Japanese Patent Laying-Open No. 3-107750.

Back to FIG. 1, the control device of a microwave oven 50 according to the present embodiment includes a control circuit 21 to be driven by a power supply from an AC power source 42 through a power source portion 39. The circuit 21 generally comprises a one-chip microcomputer which processes data of respective sensor outputs of a weight sensor 9, an oven temperature sensor 10, a room temperature sensor 11 and a smell sensor 22, and key input data from a key input portion 40 provided on the front surface of the oven 50 and including a group of keys for externally operating the oven 50, and drives and controls a display portion 37, a sound output portion 38 and a heating portion 45. The display portion 37 comprises display elements for displaying a heating time etc. in a digital manner, while the sound output portion 38 includes a speaker or the like for announcing a user near the oven 50 by sound which is converted from the state of cooked food 13, abnormal heating (firing of the food 13) of the food and the like. The heating portion 45 includes a magnetron 4 and a heater 5, to which power necessary for driving is supplied from the power source 42.

As shown in the figure, provided on the power supply path from the power source 42 to the oven 50 itself are a switch 34 and a switch 41, contact points of which switches are turned on/off by a relay, for example. On/off of the switch 34 is controlled by the control circuit 21. The switch 34 is on in a normal state, thereby establishing a power supply path between the AC power source 42 and the power source portion 39. When the control circuit 21 turns off the switch 34, the abovedescribed power supply path is cut off thereafter to prevent power supply to the oven 50. On/off of the switch 41 is also controlled by the control circuit 21 and the switch is in an off state when the oven is not in cooking operation. When the user instructs a start of heating for cooking through the key input portion 40, the circuit 21 periodically controls on/off the switch 41 following a predetermined program as described later to adjust the output of the heating portion 45. When the circuit 21 detects overheating of the food 13 by the heating portion 45 during cooking, for example, the circuit 21 turns off the switch 41, thereby cutting off power supply from the power source 42 to the heating portion 45 thereafter. Heating is immediately interrupted at the time of overheating even if the oven is in cooking operation. Control of the switches 34 and 41 will be described in more detail later.

Herein, the control circuit 21 will be described. As described previously, the circuit 21 generally comprises a one-chip microcomputer and is provided with a food distinguishing portion 23, heating control portion 24, heating stopping portion 35 and a state of cooked food determining portion 36 for the respective functions.

The food distinguishing portion 23 stores, in a memory (not shown) in advance, standard patterns of a light transmittance of the pigment film 25 in the sensor 22 according to a plurality of kinds of foods and smoke generated from food taking fire. Then, when the light transmittance pattern is obtained from the sensor 22, the distinguishing portion 23 matches the obtained pattern with each of previously stored standard patterns by a predetermined smell sensor program processing to identify a kind of food corresponding to the matching standard pattern as the kind of the food 13 in the heating chamber 2. This identification result is applied to the heating control portion 24.

The heating control portion 24 stores, in a memory (not shown), cooking sequence program corresponding to each kind of a plurality of foods in advance. The cooking sequence program is used to turn on/off the switch 41 to adjust the output of the heating portion 45. After starting the cooking, the heating control portion 24 searches the memory using the kind of the food 13 input from the distinguishing portion 23 and specifies a cooking sequence program corresponding to the kind to enter a program executable state. Then, the heating control portion 24 sets a heating time according to the food 13 etc. in the program, based on the weight of the food 13 sensed by the weight sensor 9 and the room temperature sensed by the room temperature sensor 11. The switch 41 is controlled on/off according to the heating time etc. by the program, thereby activating the heating portion 45 to heat the food 13. When the sensor 22 senses smoke of the taking fire of the food 13 during the heating, the control portion 24 turns off the switch 41 in response thereto to stop the heating portion 45 from heating thereafter. A time passage in the heating is sequentially displayed in the display portion 37.

The heating stopping portion 35 stores, in a memory (not shown) in advance, a standard pattern of the abovedescribed light transmittance related to smoke generated as a result of firing of a substance, for example, a part of the oven 50 other than food. When the light transmittance pattern obtained by the sensor 22 matches with the above-described standard pattern stored in advance, the stopping portion 35 immediately turns off the switch 34 to cut off a power supply to the oven 50 itself. In other words, if smoke caused by fire is detected when the oven 50 is not in cooking operation, which is regarded as overheating of a part of the oven 50 itself, power supply to the oven 50 is cut off in order to prevent other parts from being damaged and avoid causing a fire.

The cooked food determining portion 36 determines the state of cooked food 13 during cooking performed by the heating control portion 24 based on food heating information. The food heating information include contents as to whether deviation in weight of the food 13 obtained by the sensor 9, for example, reaches a level indicative of the finish of cooking, or as to whether a rise of the temperature in the heating chamber 2 sensed by the sensor 10 reaches a level indicative of the finish of the cooking of the food 13. Upon the determination of the completion of the cooked food 13, the determining portion 36 makes a determination of the completion of the cooking. In response thereto, the control portion 24 turns off the switch 41 to stop heating of the food 13, thereby completing cooking. At the completion of the cooking, the determining portion 36 causes the sound output portion 38 to announce the completion of the cooking of the food 13.

Figure 4:
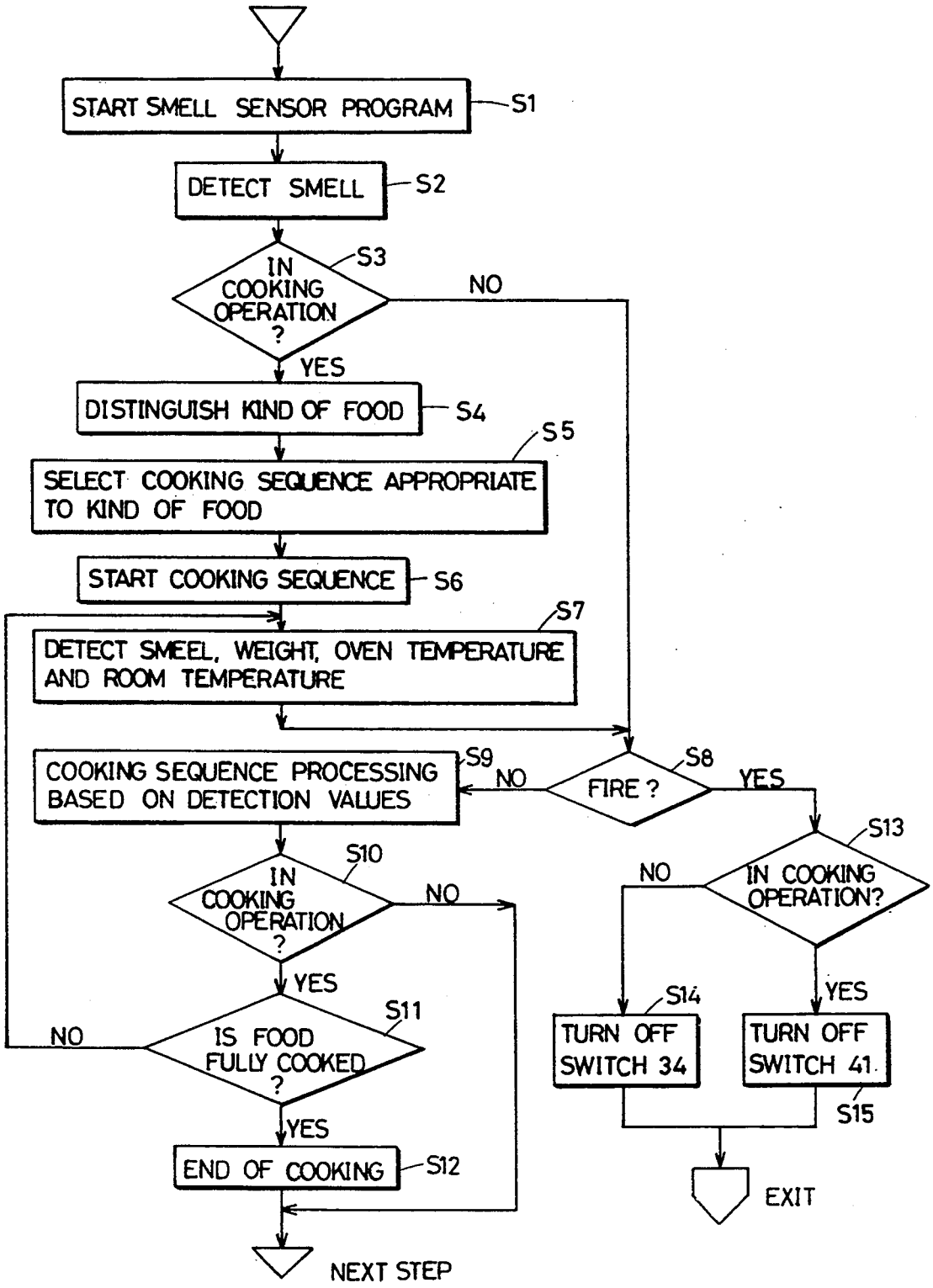
FIG. 4 is a flow chart of processing for food heating control in the microwave oven according to one embodiment of the present invention.

FIG. 4 is a flow chart of processings of food heating control in the microwave oven 50 according to one embodiment of the present invention. Food heating control operation of the microwave oven 50 will be described based on the processing flow of FIG. 4 with reference to FIGS. 1, 2, 3A and 3B. With the switch 34 being on and the switch 41 being off, the power supply path between the power source 42 and the oven 50 itself is established to allow the oven to enter a heat cooking operation.

First, the user puts the food 13 in the heating chamber 2 of the oven 50 as shown in FIG. 2 and operates the key input portion 40 of the oven 50 to apply a cooking start signal to the heating control portion 24. The control portion 24 starts controlling on/off the switch 41 in response to the input of the cooking start signal, whereby the heating portion 45 starts heating.

The food distinguishing portion 23 of the control circuit 21 also receives the above-described cooking start signal to activate the smell sensor program at step S1 (referred to as S1 in the chart) of FIG. 4.

In this program, smell included in the atmospheric flow 14 is detected by the processing at step S2. More specifically, the food 13 starts giving out peculiar smell when heating is started. The smell is mixed in the atmospheric flow 14 and detected by the smell sensor 22 when it passes through the passage 16. In other words, a peculiar smell component given out of the food 13 is absorbed into the smell sensing body 27 of the smell sensor 22, so that tone of the pigment film 25 on the substrate 26 is changed. For example, four pigment films 25*a*, 25*b*, 25*c* and 25*d* are changed to green, brown, blue and red, respectively, in odorless air. When they absorb a component of smell of banana (isoamyl acetate), they are changed to green, brown, light blue and light red, respectively. When they absorb irritating smell (methanol) component, they are changed to red purple, yellow, light blue and light red, respectively. The tone of the film 25 is determined by a pattern of a light transmittance of each of the pigment films 25*a*–25*d*, the light emitted from the light emitting element 31 and having passed through the film 25 and the filter 33. The light transmittance pattern is calculated by the smell sensor program based on a light receiving level of each of the light receiving elements 32*a*–32*d*. Thus calculated light transmittance pattern corresponds to the smell mixed in the atmospheric flow 14, that is, the peculiar smell of the food 13, for example.

In the smell sensor program, whether the oven 50 is in a cooking operation or not is determined based on whether a signal for driving the heating portion 45, that is, a signal for controlling on/off of the switch 41, is output from the control portion 24 by the processing at the next step S3. If the determination is made that the oven 50 is in the cooking operation, the program proceeds to step S4, while if the determination is made that it is not in the cooking operation, the program proceeds to step S8 which will be described later.

In the smell sensor program, the processing is carried out at the next step S4 to match the abovedescribed pattern of transmittances obtained at step S2 with standard light transmittance patterns stored in the memory in advance to specify a matching standard pattern. Then, the kind of food corresponding to the specified standard pattern is determined to be that of the food 13 in the heating chamber 2. Information concerning the determined kind of the food 13 is applied to the heating control portion 24.

In the processing at the next step S5, the heating control portion 24 selects a cooking sequence program suitable for the kind of the food 13, as described previously. In the processing at the next step S6, the selected cooking sequence program is executed in accordance with a heating time according to the food 13 obtained based on the weight of the food 13 sensed by the weight sensor 9. In other words, the control portion 24 starts controlling on/off the switch 41 in accordance with a cycle of the sequence program, whereby the heating portion 45 starts heating.

At the next step S7, for sensing the cooking state of the food 13 heated by the heating portion 45, the outputs of the sensors 22, 9, 10 and 11 are input to obtain smell and weight of the food 13 during cooking, and the temperature in the heating chamber 2 and the ambient temperature of the oven 50 during the same in the cooking sequence program.

Thereafter, the program proceeds to the processing at the next step S8 wherein determination is made as to whether the food 13 takes fire due to overheating or not, based on the smell during the cooking obtained at the above-described step S7. More specifically, in the smell sensor program, the above-described matching is made with respect to a light transmittance pattern obtained based on the output of the smell sensor 22 to determine whether the pattern matches with that of smoke or not. The determination result is applied to the cooking sequence program. If the pattern does not match with that of the smoke, which is regarded as no detection of fire of the food 13, the processing of the cooking sequence program proceeds to the next step S9 and thereafter. On the other hand, if the pattern matches with that of the smoke, which is regarded as a detection of the fire of the food 13, the processing proceeds to the step S13 and thereafter which will be described later.

In the cooking sequence program, a cycle of on/off control of the switch 41 is obtained by the processing at step S9 based on the weight of the food 13, the temperature in the heating chamber 2 and the room temperature obtained at the above-described step S7 in order to continue heat cooking of the food 13. Output of the heating portion 45 is adjusted by on/off controlling the switch 41 in accordance with the cycle.

Thereafter, in the cooking sequence program, determination is made in the processing at step S10 whether the oven 50 is in the cooking operation or not in the same manner as that in the above step S3. If the determination is made that it is not in the cooking operation, the processing of the cooking sequence program finishes to start a processing of another program. If the determination is made that it is in the cooking operation, the cooking sequence program proceeds to the processing at the next step S11.

In the processing at step S11, the cooked food determining portion 36 determines the completion of cooked food 13. The determining portion 36 which stores in advance the output deviation of the weight sensor 9 and the output deviation of the temperature sensor 10, for example, as data which are used to determine the completion of cooked food according to the kind of the food 13, determines the completion of cooked food when the output deviations of the sensors 9 and 10 coincide with such data. The determination result is applied to the cooking sequence program, which program proceeds to the processing at the next step S12. In the processing at the step S12, heating operation of the heating portion 45 is stopped to terminate the cooking of the food 13. In other words, the control portion 24 turns off the switch 41 thereafter, to perform control for cutting off the power supply path from the power source 42 to the heating portion 45. In parallel therewith, the sound output portion 38 announces the finish of the cooking. Thereafter, the processings of the cooking sequence program finish to start a processing of another program.

Back to the processing at the above-described step S11, if no determination is made on the state of the cooked food 13, the flow returns to step S7 to carry out heat cooking thereafter in the same manner as described above while determining whether the food 13 taking fire due to overheating or not.

Back to the processing at the above step S8, when the generation of smoke due to the fire is detected, the flow proceeds to the processings at the next step S13 and the following steps.

In the processing at the step S13, whether the oven 50 is in the cooking operation or not is determined based on whether the control portion 24 outputs a signal for controlling on/off of the switch 41 or not. If the oven 50 is not in the cooking operation, that is, if the fire is detected when the oven 50 is not in the cooking operation through the processings at the above-described steps S3 and S8, the flow proceeds to the processing at the next step S14 wherein the heating stopping portion 25 turns off the switch 34. As a result, the power supply path from the power source 42 to the oven 50 is thereafter cut off. Thus, if the fire is detected when the oven 50 is not in the cooking operation, this is considered that the oven 50, out of order, is being supplied with excessive power to have its component take fire. Then, power supply to the oven 50 is cut off to avoid further damage to the oven 50° Therefore, safety of the oven 50 is increased, while maintenance cost is reduced. In parallel with turning-off of the switch 34, the sound output portion 38 announces that the oven 50 takes fire.

Back to the processing at step S13, if the determination is made that the oven 50 is in the cooking operation, that is, if it is detected through the processings at the above-described steps S7 and S8 that the food 13 takes fire due to overheating, the flow proceeds to the processing at the next step S15 wherein the control portion 24 turns off the switch 41. As a result, the heating portion 45 stops outputting thereafter, thereby interrupting the heating of the food 13. Thus, since the heating portion 45 is immediately stopped when the food 13 is detected taking fire due to overheating during the cooking, it is possible to find the food 13 browning due to overheating at an early stage to automatically interrupt the heating before the browning spreads into the food 13. It is also possible to avoid damage to the heating portion 45 caused by an abnormally high temperature. In parallel therewith, the sound output portion 38 announces that the food 13 takes fire.

After finishing the processing at the above-described step S14 or step S15, the processing of the cooking sequence program is completed.

As described in the foregoing, the switch 34 or 41 is turned off upon the detection of the fire, thereby immediately cutting off the power supply path to the oven 50 or the heating portion 45. Therefore, as compared with a case where a conventional thermo fuse is used for cutting off the above-described power supply path, a time required for cutting off the path is considerably reduced, so that damage to the oven 50 or the food 13 in the heating chamber 2 can be minimized.

In addition, since a kind of the food 13 is distinguished by the smell sensor 22 as described above, automatic cooking according to the kind of the food 13 is possible only by pressing a cooking start button of the key input portion 40 at a start of heating, without requiring other key operations.

As the pigment film 25 of the smell sensing body 27 of the smell sensor 22 uses triphenylmethane phthalyde pigment and indolyl phthalyde pigment whose color shade is changed by heat, it may be structured such that the state of cooked food 13 is determined based on food heating information with respect to the pigment film to be changed by temperature. In other words, a sense output of the smell sensor 22, in place of the output of the sensor 10, is applied to the cooked food determining portion 36. The determining portion 36 receives the output of the smell sensor 22 and the output of the weight sensor 9 as food heating information and determines the state of the cooked food 13 based on the information.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A heat cooking apparatus comprising:

a heating chamber for storing food, heating means for heating the food in said heating chamber, a smell sensor for sensing smell of atmosphere in said heating chamber, and controlling means for controlling heat cooking of the food by said heating means, said controlling means including:

food distinguishing means for distinguishing a kind of the food in said heating chamber based on information of the smell detected by said smell sensor, said food distinguishing means having a predetermined heating pattern for specific kinds of food, heat driving means for driving and controlling said heating means based on information of the kind of the food output from said food distinguishing means said driving means having predetermined heating programs corresponding to the specific kinds of food.

2. The heat cooking apparatus according to claim 1, wherein said food distinguishing means further includes first fire sensing means for sensing fire of the food in said heating chamber based on the information of smell detected by said smell sensor, and said controlling means includes heating stopping means responsive to the sense of said fire by said first fire sensing means for stopping a heating operation of said heating means.

3. The heat cooking apparatus according to claim 1, wherein said smell sensor includes:

a smell sensing portion having a substrate, and a first pigment film whose color is changed according to a component of the smell in said atmosphere and which is formed in advance on the main surface of said substrate, and a color sensing portion for reading the color of said first pigment film in said smell sensing portion to output said smell information.

4. The heat cooking apparatus according to claim 1, further comprising a first power supply path for supplying power for drive from an external power source to the heat cooking apparatus, wherein said controlling means including:

second fire sensing means for sensing fire based on the information of the smell detected by said smell sensor when the food is not being heated by said heating means, and first cutting off means responsive to the sense of said fire by said second fire sensing means for cutting off said first power supply path.

5. The heat cooking apparatus according to claim 2, further comprising a second power supply path for supplying power for drive from an external power source to said heating means, wherein said heating stopping means includes second cutting off means responsive to the sense of the fire of the food in said heating chamber by said first fire sensing means for cutting off said second power supply path.

6. The heat cooking apparatus according to claim 3, wherein said smell sensing portion includes a second pigment film whose color shade is changed according to the temperature of said atmosphere and which is formed on the main surface of said substrate in advance, said color sensing portion further includes a temperature sensing portion for reading color shade of said second pigment film and outputting information relating to the temperature of said atmosphere, and said controlling means includes:

cooked food determining means for determining the state of said heated food based on heating information including said temperature information output from said temperature sensing portion, and means for controlling said heating means based on the determination result of the state of the cooked food by said cooked food determining means.

7. The heat cooking apparatus according to claim 4, wherein said first cutting off means includes:

first switching means for assuming a first state and a second state other than said first state in said first power supply path and for cutting off said first power supply path when in said first state, and means for setting said first switching means to operate in said first state in response to said second fire sensing means sensing fire.

8. The heat cooking apparatus according to claim 5, wherein said second cutting off means includes:

second switching means for assuming a first state and a second state other than said first state in said second power supply path and for cutting off said second power supply path when in said first state, and means for setting said second switching means to operate in said first state in response to said first fire sensing means sensing fire of the food in said heating chamber.

9. The heat cooking apparatus according to claim 1, wherein said heating means supplies heat wave and/or high frequency radiowave to said heating chamber.

10. A heat cooking apparatus comprising:

a heating chamber for storing food, heating means for heating the food in said heating chamber, a smell sensor for sensing the smell of the atmosphere in said heating chamber, and controlling means for controlling heat cooking of the food by said heating means, said controlling means including:

food distinguishing means for distinguishing the kind of the food in said heating chamber based on information of the smell detected by said smell sensor, said food distinguishing means having a predetermined heating pattern for specific kinds of food, and heat driving means for driving and controlling the heating means in accordance with heating sequence based on information of the kind of food provided from the food distinguishing means, said means for driving heating programs corresponding to the specific kinds of food, so that the food can be cooked without manually pre-designating the kind of food that is to be cooked.

* * * * *